US006316582B1

(12) United States Patent
Bjur et al.

(10) Patent No.: US 6,316,582 B1
(45) Date of Patent: Nov. 13, 2001

(54) USE OF AN ALKOXYLATED POLYAMINE SURFACTANT AS A VISCOSE SPIN BATH ADDITIVE

(75) Inventors: Kent Bjur, Stenungsund; Anders Cassel, Myggenas; Margreth Strandberg, Stenungsund; Ingemar Uneback, Svenshogen, all of (SE)

(73) Assignee: Akzo Nobel N.V. (NL)

( * ) Notice: Subject to any disclaimer, the term of this patent is extended or adjusted under 35 U.S.C. 154(b) by 0 days.

(21) Appl. No.: 09/585,114

(22) Filed: Jun. 1, 2000

Related U.S. Application Data

(63) Continuation of application No. PCT/SE98/01895, filed on Oct. 21, 1998.

(30) Foreign Application Priority Data

Dec. 5, 1997 (SE) ..... 9704535

(51) Int. Cl.[7] ..... C08G 8/02; C08L 1/24

(52) U.S. Cl. ..... 528/229; 528/220; 264/191; 264/194; 264/205; 264/207; 106/166.4; 106/166.5; 106/168.01; 252/8.81; 252/8.86

(58) Field of Search ..... 528/229, 220; 264/191, 194, 205, 207; 252/8.81, 8.86; 106/166.4, 166.5, 168.01

(56) References Cited

U.S. PATENT DOCUMENTS 4,025,353 * 5/1977 Wahlen ..... 106/165

6,068,689 * 5/2000 Bjur et al. ..... 106/166.8

OTHER PUBLICATIONS

*International Search Report*, dated Feb. 4, 1999.

*Derwent abstract*, JP54101916, dated Aug. 10, 1979.

*Derwent abstract*, JP73006409, dated Sep. 1973.

* cited by examiner

*Primary Examiner*—P. Hampton-Hightower
(74) *Attorney, Agent, or Firm*—Ralph J. Mancini

(57) ABSTRACT

The present invention relates to a method of reducing the clogging of nozzles and slits and diminishing the formation of deposits in the spin bath system in the process of making viscose filamentary and film materials by using an alkoxylated polyamine surfactant having the formula:

$$RNA\text{-}(C_nH_{2n}NA)_{x-1}A \qquad (I)$$

where R represents a hydrogen or an aliphatic group with 1–24 carbon atoms, each A represents a hydrogen, an aliphatic group with 1–24 carbon atoms, or $H(OC_mH_{2m})_y$-groups, where m is a number from 2–3, n is a number from 2–3, x is 4–8, with the proviso that the number of $H(OC_mH_{2m})_y$-groups are from 1 to x+1, and the total number of carbon atoms in the aliphatic groups is from 8 to 45. The alkoxylated polyamine surfactant has an excellent anticlogging effect, since it is a good dispersant and prevent or reduce precipitation in the spin bath. In addition it is very stable.

12 Claims, No Drawings

USE OF AN ALKOXYLATED POLYAMINE SURFACTANT AS A VISCOSE SPIN BATH ADDITIVE

This is a continuation of PCT Application No. PCT/SE98/01895 filed Oct. 21, 1998 which claims priority of Swedish patent application No. 9704535-5 filed on Dec. 5, 1997.

FIELD OF THE INVENTION

The present invention relates to a method of reducing the clogging of nozzles and slits and diminishing the formation of deposits in the spin bath system in the process of making viscose filamentary and film materials by using an alkoxylated polyamine surfactant.

BACKGROUND OF THE INVENTION

When regenerating cellulose material in an acidic spin bath containing zinc sulphate,disturbancies frequently occur due to the presence of clogging material. The origins of the clogging material are different. One and the most important source are solid by-products, i.e. elementary sulphur and zinc sulphide, which are formed when the dissolved xanthogenated celluloses are regenerated to cellulose and carbon disulphide. Other examples of clogging by-products are hemicelluloses and resins derived from the cellulosic raw material itself and transfered to the spin bath where they cause deposits.

One method of reducing these disadvantages is to add cationic surface active compounds to the spinning baths. Thus, in Japanese Patent No. 48006409 it is suggested to add N,N'-polyoxyethylene-N-long chain-alkyl alkylene-diamines and N,N',N'-polyoxyethylene-N-long chain-alkyl alkylene-triamines into the spin bath as dispersants for sulphur particles which cause blockages in spinning nozzles. The long-chain alkyl group contains from 10 to 20 carbon atoms. The number of oxyethylene groups are from 1 to 8 for each substitution position and their sum is from 2 to 10. However, these additives have a rather limited ability to disperse sulphur, especially when the amounts thereof is high.

In Japanese Patent Application No. 54101916 it is suggested to add polyoxyethylene alkyl mono- and diamide polyalkylene polyamines to further reduce the clogging of nozzles. Examples of the used polyalkylene polyamines are triethylene tetramine and tetraethylene pentamine. The number of carbon numbers in the fatty acids used for preparing the said compounds is preferably from 12 to 22, while the number of groups derived from ethylene oxide in the molecule is from 6 to 12. Although these polyamines have a good dispersing effect they have a serious drawback since they are not stable in hot acid solutions and are hydrolyzed at high temperature in the spin bath. Consequently, after some time their effect is essentially reduced.

The degradation of the additive can be compensated by addition of higher dosages of the additives. However in practice the resulting products of the hydrolysis, i.e. the fatty acids produced especially during reconditioning of the spin bath, enhances the clogging. Together with elementary sulphur and/or zinc sulphide and resins they form black particles, which are very difficult to disperse.

It is therefore an object of the invention to overcome the deficiencies of the prior art.

SUMMARY OF THE INVENTION

The present invention generally relates to the use of an alkoxylated polyamine surfactant having the general formula $$RNA\text{-}(C_nH_{2n}NA)_{x-1}A \quad (I)$$

where R represents a hydrogen or an aliphatic group with 1–24 carbon atoms, each A represents hydrogen, an aliphatic group with 1–24 carbon atoms or an $H(OC_mH_{2m})_y$-group, where m is a number from 2–3, y is a number from 1 to 5, n is a number from 2–3, x is 4–8, with the proviso that the number of $H(OC_mH_{2m})_y$-groups are from 1 to x+1, and the total number of carbon atoms in the aliphatic groups is from 8 to 45, as a viscose spin bath additive.

DETAILED DESCRIPTION OF THE INVENTION

It has now been found that not only the disturbancies of clogging materials in the spin bath essentially diminished but also the quality of the fibers formed in the spin bath is improved by using an alkoxylated polyamine surfactant having the formula $$RNA\text{-}(C_nH_{2n}NA)_{x-1}A \quad (I)$$

where R represents a hydrogen or an aliphatic group with 1–24 carbon atoms, each A represents a hydrogen, an aliphatic group with 1–24 carbon atoms, or $H(OC_mH_{2m})_y$-groups, where m is a number from 2–3, and y is a number from 1 to 5, n is a number from 2–3, x is 4–8, with the proviso that the number of $H(OC_mH_{2m})_y$-groups are from 1 to x+1, and the total number of carbon atoms in the aliphatic groups is from 8 to 45, as a viscose spin bath additive. The alkoxylated polyamine surfactant has an excellent anticlogging effect, since it is a good dispersant and prevent or reduce precipitation in the spin bath. In comparison with the diamines and triamines disclosed in JP 48006409 the anti-clogging and dispersing effects are essentially improved. In addition it is very stable in comparison with the amide compounds disclosed in JP Patent Application No. 54101916.

Since the additive keeps the openings in the spinneret free from clogging materials, the filaments and films formed collect less solid particles, whereby the discolouration is reduced and the fiber or film strength improved. In addition the maintainance of the spin bath is also simplyfied. Since the alkoxylated polyamine surfactant has a high stability in ordinary working-up-processes of the spin bath, the spin bath solution can be recirculated after the removal of an excess of the by-products including sodium sulphate formed in the spin bath. The amount of the alkoxylated polyamine surfactant in the spin bath may be varied within wide limits but is normally added in an amount of 0.5–5000 ppm, preferably from 2 to 1000 ppm, to a spin bath containing 5–15% by weight $H_2SO_4$, 15–30% by weight of $Na_2SO_4$ and 0–7% by weight of $ZnSO_4$.

The alkoxylated polyamine surfactant with formula I preferably contains one or two aliphatic groups, R and A, with a total of 8 to 40 carbon atoms, preferably between 10 and 36 carbon atoms. Preferably R is a hydrocarbon group with 8–24 carbon atoms, and most preferably a hydrocarbon group with 10–22 carbon atoms, while m is 2 and the total number of $OC_2H_4$-units are from 4 to 30.

Most preferred alkoxylated polyamine surfactants of the formula I are those having the formula $$RNA\text{-}(C_3H_6NA)_{x-1}A \quad (II)$$

where R has the meaning mentioned in formula I, x is 4–6 and A is hydrogen or the group $(C_2H_4O)_yH$, where y has the meaning mentioned in formula I and the total number of $C_2H_4O$-units is from 4 to 15. These additives are easy to produce and have excellent dispersing ability.

The present invention also relates to a process for regeneration of cellulose from a viscose solution, in which process the viscose solution is brought into contact with a spin bath containing from 0.5 to 5000 ppm of an alkoxylated polyamine surfactant according to formula I. Preferably the alkoxylated polyamine surfactant has the formula II. The spin bath has normally a temperature of from 40° C. to 60° C. and contains in addition to the alkoxylated polyamine surfactant from 5 to 15% by weight of $H_2SO_4$, from 15 to 30% by weight of $Na_2SO_4$ and from 0–7% by weight of $ZnSO_4$. The cellulose regenerated may have the form of fibers or films or any other conventional shape.

The invention is further illustrated by the following examples.

EXAMPLE 1

Degradation kinetics of two spin bath additives were evaluated in a spin bath with the composition 9,5% $H_2SO_4$, 23% $Na_2SO_4$, 0,4% $ZnSO_4$ and 67,1% $H_2O$ at different temperatures stated in the tables below.

One of the additives was an amide condensate of tetraethylene pentamine and a tallow fatty acid ethoxylated with 10 moles ethylene oxide per mol amide, hereinafter referred to as Compound B. Compound B is a typical representative of an additive in the Japanese Patent Application No. 54101916. The other additive was an N,N',N",N'"-polyoxyethylene-N-(tallow alkyl)tetraamine with 7.5 moles oxyethylene per mole tetraamine. This additive is a typical representative of an alkoxylated polyamine surfactant according to this invention.

The content of Compound B and Compound 1 in the spin bath solutions were analyzed by using the dye Orange II. This dye and the cationic surfactant were reacted and the complex formed was extracted into chloroform. Then the amount of the complex in the chloroform phase was spectrofotometrically determined at a wave length of 488 nm.

The data obtained are presentated below in Tables 1 and 2.

The figures show the residual non-degraded amount of Compound B and Compound 1 in %.

TABLE 1

| | Content of Compound B, % | | | |
|---|---|---|---|---|
| | Temperature | | | |
| Time, h | 22° C. | 50° C. | 70° C. | reflux |
| 0 | 100 | 100 | 100 | 100 |
| 6 | 90 | 80 | 70 | 35 |
| 24 | 90 | 75 | 60 | 20 |
| 48 | 90 | 65 | 50 | 15 |

TABLE 2

| | Content of Compound 1, % | | | |
|---|---|---|---|---|
| | Temperatures | | | |
| Time, h | 22° C. | 50° C. | 75° C. | reflux |
| 0 | 100 | 100 | 100 | 100 |
| 6 | 100 | 100 | 100 | 100 |
| 24 | 100 | 100 | 100 | 100 |
| 48 | 100 | 100 | 100 | 100 |

From the results it is evident that the stability in the hot spin bath solution is much lower for the amide type of spin bath additive (Compound B) than for the additive according to the invention (Compound 1).

EXAMPLES 2–4

Precipitation prevention and dispersing capacities of some spin bath additives were determined according to the following procedure.

21 ml of a solution containing 0.25 M $Na_2S_2O_3$, 0.15 M $Na_2CS_3$ and 0.25 M $Na_2S$ was dropwise added during stirring into a polypropylene vessel containing 1 liter of a spin bath. The spin bath contained 10% by weight $H_2SO_4$, 20% by weight $Na_2SO_4$, 1% by weight $ZnSO_4$, 69% by weight $H_2O$ and a dispersing additive from 0–25 ppm. Its temperature was 50° C. The stirrer was made of glass with a propellar of platinum. After the addition the transmittance of the bath was measured after predetermined times in a spectrophotometer at the wave length of 450 nm in a glass cuvette. During the whole test the stirring was kept constant at 300 rpm. After 270 minutes the test was interrupted and the weight of the stirrer was measured in order to determine the amount of material precipitated on the stirrer.

The following dispersing additives were used.

Compound A.

A compound having the formula

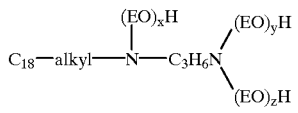

where EO is ethyleneoxy and the sum of x, y and z is 10, in accordance with the amine compounds disclosed in the Japanese Patent No. 48006409.

Compound B.

Same compound as in Example 1.

Compound C.

A compound having the formula

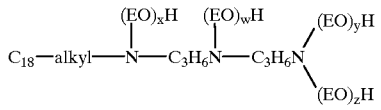

where EO is ethyleneoxy and the sum of x, y, z and w is 10.

Compound 1.

Same compound as in Example 1.

Compound 2.

Same compound as Compound 1 but the number of oxyethylene units was 6 per mole tetraamine.

The tests performed and the. results obtained are shown in Table 3 below.

TABLE 3

| | Transmittance, % Compound | | | | | | | | |
|---|---|---|---|---|---|---|---|---|---|
| | — | A | A | B | C | 1 | 1 | 1 | 2 |
| | Amount | | | | | | | | |
| Time, min | — | 5 ppm | 25 ppm | 5 ppm | 5 ppm | 5 ppm | 10 ppm | 25 ppm | 5 ppm |
| 0 | 100 | 100 | 100 | 100 | 100 | 100 | 91 | 100 | 100 |
| 30 | 57 | 71 | 67 | 39 | 59 | 84 | 33 | 95 | 80 |
| 60 | 52 | 41 | 48 | 25 | 42 | 36 | 21 | 36 | 49 |
| 120 | 47 | 38 | 42 | 32 | 35 | 30 | 19 | 15 | 35 |
| 270 | 45 | 41 | 30 | 36 | 35 | 26 | 8 | 5 | 29 |
| | Dry weight of precipitation on Pt-stirrer, mg | | | | | | | | |
| 270 | 182 | 80 | 40 | 21 | 23.2 | 0.0 | 0.0 | 0.0 | 3.5 |

It is evident that the spin bath additives in accordance with the present invention have an improved ability to disperse solid and colloidal particles and to prevent the precipitation thereof in comparison with the spin bath additive disclosed in the Japanese Patent No. 48006409 and Japanese Patent Application No. 54101916.

We claim:

1. A spin bath solution for the regeneration of cellulose which comprises an alkoxylated polyamine surfactant having the general formula $$RNA\text{-}(C_nH_{2n}NA)_{x-1}A \quad (I)$$

where R represents a hydrogen or an aliphatic group with 1–24 carbon atoms, each A represents hydrogen, an aliphatic group with 1–24 carbon atoms or an $H(OC_mH_{2m})_y$-group, where m is a number from 2–3, y is a number from I to 5, n is a number from 2–3, x is 4–8, with the proviso that the number of $H(OC_mH_{2m})_y$-groups are from 1 to x+1, and the total number of carbon atoms in the aliphatic groups is from 8 to 45, as a viscose spin bath additive.

2. The spin bath of claim 1, wherein the bath contains from 5 to 15% by weight of $H_2SO_4$, from 15 to 30% by weight of $Na_2SO_4$ and from 0 to 7% by weight of $ZnSO_4$.

3. The spin bath of claim 1 wherein the alkoxylated polyamine surfactant is present in an amount of from 0.5 to 5000 ppm in the spin bath.

4. The spin bath of claim 1 wherein the alkoxylated polyamine surfactant has the formula $$RNA\text{-}(C_3H_6NA)_{x-1}A \quad (II)$$

where R and x have the meaning mentioned in formula I, and A is a hydrogen or the group $(C_2H_4O)_yH$, where y is a number from 1–5, and the total number of $C_2H_4O$-units is from 4 to 15.

5. The spin bath of claim 1 wherein the alkoxylated polyamine surfactant is added as a dispersant and precipitation reducing additive.

6. A process for regeneration of cellulose from a viscose solution in a spin bath which comprises contacting a viscose solution with a spin bath containing from 0.5 to 5000 ppm of at least one alkoxylated polyamine surfactant of claim 1.

7. The process of claim 6 wherein the spin bath solution additionally comprises from 5 to 15% by weight of $H_2SO_4$, from 15 to 30% by weight of $Na_2SO_4$ and from 0–7% by weight of $ZnSO_4$.

8. The process of claim 7 wherein the alkoxylated polyamine surfactant has the formula $$RNA\text{-}(C_3H_6NA)_{x-1}A \quad (II)$$

where R and x have the meaning mentioned in formula I, and A is a hydrogen or the group $(C_2H_4O)_yH$, where y is a number from 1–5, and the total number of $C_2H_4O$-units is from 4 to 15.

9. A method of reducing the clogging of nozzles and slits in the process of making viscose filamentary and film material from a spin bath, said method comprising adding to said spin bath an alkoxylated polyamine having the general formula $$RNA\text{-}(C_nH_{2n}NA)_{x-1}A \quad (I)$$

where R represents a hydrogen or an aliphatic group with 1–24 carbon atoms, each A represents hydrogen, an aliphatic group with 1–24 carbon atoms or an $H(OC_mH_{2m})_y$-group, where m is a number from 2–3, y is a number from 1 to 5, n is a number from 2–3, x is 4–8, with the proviso that the number of $H(OC_mH_{2m})_y$-groups are from 1 to x+1, and the total number of carbon atoms in the aliphatic groups is from 8 to 45.

10. The method of claim 9, wherein the bath contains from 5 to 15% by weight of $H_2SO_4$, from 15 to 30% by weight of $Na_2SO_4$ and from 0 to 7% by weight of $ZnSO_4$.

11. The method of claim 9 wherein the alkoxylated polyamine surfactant is present in an amount of from 0.5 to 5000 ppm in the spin bath.

12. The method of claim 9 wherein the alkoxylated polyamine surfactant has the formula $$RNA\text{-}(C_3H_6NA)_{x-1}A \quad (II)$$

where R and x have the meaning mentioned in formula I, and A is a hydrogen or the group $(C_2H_4O)_yH$, where y is a number from 1–5, and the total number of $C_2H_4O$-units is from 4 to 15.

* * * * *